US005669045A

United States Patent [19]

Swain

[11] Patent Number: 5,669,045

[45] Date of Patent: Sep. 16, 1997

[54] ELECTROSTATOGRAPHIC IMAGING MEMBER AND PROCESS FOR FABRICATING MEMBER

[75] Inventor: Eugene A. Swain, Webster, N.Y.

[73] Assignee: Xerox Corp., Stamford, Conn.

[21] Appl. No.: 652,254

[22] Filed: May 23, 1996

Related U.S. Application Data

[63] Continuation of Ser. No. 296,762, Aug. 26, 1994, abandoned.

[51] Int. Cl.[6] ..... G03G 15/00

[52] U.S. Cl. ..... 399/159; 29/895.21

[58] Field of Search ..... 355/200, 211; 492/16, 18, 47, 49, 53; 29/895.2, 895.21, 895.22, 895.23; 399/159

[56] References Cited

U.S. PATENT DOCUMENTS

| | | | |
|---|---|---|---|
| 3,646,652 | 3/1972 | Heiligenthal et al. | 492/53 |
| 4,023,967 | 5/1977 | McGibbon | 355/211 X |
| 4,292,386 | 9/1981 | Takano | 355/211 X |
| 4,317,270 | 3/1982 | Watanabe et al. | 492/53 X |
| 4,378,622 | 4/1983 | Pinkston et al. | 29/895.21 |
| 4,601,963 | 7/1986 | Takahashi et al. | 355/211 X |
| 5,160,421 | 11/1992 | Milnyk et al. | 205/67 |
| 5,430,526 | 7/1995 | Ohkubo et al. | 355/211 |

FOREIGN PATENT DOCUMENTS

| | | | |
|---|---|---|---|
| 0526208 | 2/1993 | European Pat. Off. . | |
| 0590924 | 4/1994 | European Pat. Off. . | |
| 0060480 | 3/1988 | Japan | 355/211 |
| 0060481 | 3/1988 | Japan | 355/211 |
| 0035167 | 2/1993 | Japan | 355/211 |
| 0035166 | 2/1993 | Japan | 355/211 |
| 0188839 | 7/1993 | Japan | 355/211 |
| 1457776 | 8/1976 | United Kingdom . | |

OTHER PUBLICATIONS

IBM Technical Disclosure Bulletin, vol. 33, No. 11, Apr. 1991 New York, US, pp. 107–108.

*Primary Examiner*—Robert Beatty

[57] ABSTRACT

An electrostatographic imaging member assembly including a hollow cylindrical electrostatographic imaging member, the member including a substrate, an exterior imaging surface, an interior back surface, a first end and a second end, a rigid cylindrical core support member located within the interior of and coaxially aligned with the cylindrical electrostatographic imaging member, the cylindrical core support member extending from at least the first end to the second end of the imaging member and having an outer surface spaced from the interior back surface of the hollow cylindrical photoreceptor and at least one preformed resilient compressible sleeve under compression between the back surface of the imaging member and outer surface of the cylindrical core support, the compression being sufficient to render the electrostatographic imaging member substantially rigid and substantially free from distortion under electrostatographic image cycling conditions. A process for fabricating this imaging member is also disclosed.

23 Claims, 4 Drawing Sheets

ELECTROSTATOGRAPHIC IMAGING MEMBER AND PROCESS FOR FABRICATING MEMBER

This is a continuation of application Ser. No. 08/296,762, filed Aug. 26, 1994 abandoned.

BACKGROUND OF THE INVENTION

This invention relates in general to an electrostatographic imaging system and more specifically to an assembly comprising an electrostatographic imaging member and support means.

Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of each drum. The hub usually includes a flange extending into the interior of the drum. This flange is usually retained in place by an interference fit and/or an adhesive. An axle shaft through a hole in the center of each hub supports the hub and drum assembly. Electrostatographic imaging members may be electrophotographic members or electrographic. It is well known that electrophotographic members comprise at least one photosensitive imaging layer and are imaged with the aid of activating radiation in image configuration whereas electrographic imaging members comprise at least one dielectric layer upon which an electrostatic latent image is formed directly on the imaging surface by shaped electrodes, ion streams, styli and the like. A typical electrostatographic imaging process cycle involves forming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members. Cleaning can also be accomplished by contact of the imaging system with webs or brushes.

When flexible cylindrically shaped electrostatographic imaging members are cycled in electrostatographic imaging processes, physical contact between the imaging member and various components of subsystems utilized in the imaging cycle can cause distortion of the imaging member. This distortion can adversely affect the quality of images obtained. More specifically, distortion can occur during contact with conventional subsystems such as development, transfer and/or cleaning subsystems. Distortion can be particularly pronounced when the flexible cylindrically shaped electrostatographic imaging member comprises a thin flexible substrate. Representative of final toner images adversely affected by distortion of the imaging member during imaging, are image areas devoid of toner, smeared toner images, toner deposits in background areas and the like.

A foamed filling can be formed in situ in the interior of photoreceptor drums. These devices perform well for their intended purpose, but it is difficult to disassemble and recycle the photoreceptor drum components for reuse because the filling material must be removed by labor intensive techniques such as scraping, dissolving, incinerating or the like. Moreover, removal of the foam normally results in the destruction of the foam material and prevents its reuse.

A common technique for fabricating photoreceptor assemblies involves cementing an end flange to each end of a photoreceptor drum. This approach also requires complex and labor intensive cement applying steps. In addition, disassembly is difficult and the end caps can be damaged during removal from the ends of the drums. Damage to the end caps renders the end caps useless for recycling. Also, cement material adhering to the end caps and drum ends must be removed to enable recycling.

Thus, there is a continuing need for improved electrostatographic imaging members that are more reliable and simpler to fabricate.

INFORMATION DISCLOSURE STATEMENT

U.S. Pat. No. 5,160,421 issued to A. Melnyk et al. on Nov. 3, 1992. An electroforming process is disclosed for preparing an electroformed metal layer on the inside surface of a female mandrel to form an electroform with a hollow interior. A device may be positioned within the hollow interior of the electroform, and the interior is filled with a filling material. The electroform may then be separated from the mandrel by a force applied to the device positioned within the filling material.

In a concurrently filed application Ser. No. 08/296,564, entitled "ELECTROSTATOGRAPHIC IMAGING MEMBER ASSEMBLY" filed Aug. 26, 1994 in the names of R. E. Godlove et al., an electrostatographic imaging member assembly is described which includes an electrostatographic imaging member comprising a substrate, an electrostatographic imaging layer, an imaging surface on the imaging layer, a back surface on the substrate, and a preformed resilient porous gas filled acoustic dampening member at least partially compressed and in pressure contact with the back surface, the pressure contact being sufficient to substantially eliminate relative movement between the substrate and the acoustic dampening member.

SUMMARY OF THE INVENTION

It is, therefore, an object of the present invention to provide an improved electrostatographic imaging member assembly which overcomes the above-noted disadvantages.

It is another object of this invention to provide an improved electrostatographic imaging member assembly which enables the use of flexible cylindrical electrostatographic imaging members in electrostatographic imaging processes.

It is still another object of this invention to provide an improved electrostatographic imaging member assembly which is simple to fabricate thereby eliminating complex fabrication process steps.

It is a further object of this invention to provide an improved electrostatographic imaging member assembly which is easily disassembled for recycling.

The foregoing and other objects of the present invention are accomplished by providing an electrostatographic imaging member assembly comprising a hollow cylindrical electrostatographic imaging member, the member comprising a substrate, an exterior imaging surface, an interior back surface, a first end and a second end, a rigid cylindrical core support member located within the interior of and coaxially aligned with the cylindrical electrostatographic imaging member, the cylindrical core support member extending from at least the first end to the second end of the imaging member and having an outer surface spaced from the interior back surface of the hollow cylindrical photoreceptor and at least one preformed resilient compressible sleeve under compression between the back surface of the imaging member and outer surface of the cylindrical core support, the compression being sufficient to render the electrostatographic imaging member substantially rigid and substantially free from distortion under electrostatographic image cycling conditions. This imaging member may be fabricated by (a) providing a hollow cylindrical electrostatographic imaging member, the member comprising a substrate, an exterior imaging surface, an interior back surface, a first end and a second end, (b) inserting at least one preformed resilient compressible sleeve within the hollow cylindrical electrostatographic imaging member, and (c) inserting a rigid cylindrical core support member within the interior of and coaxially aligned with the preformed resilient compressible sleeve and the cylindrical electrostatographic imaging member, the cylindrical core support member extending from at least the first end to the second end of the imaging member and having an outer surface spaced from the interior back surface of the hollow cylindrical photoreceptor to compress the preformed resilient compressible sleeve between the back surface of the imaging member and the outer surface of the cylindrical core support, the compression being sufficient to render the electrostatographic imaging member substantially rigid and substantially free from distortion under electrostatographic image cycling conditions.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices components thereof.

DETAILED DESCRIPTION OF THE DRAWINGS

The present invention may be employed with any suitable hollow cylindrical electrostatographic imaging member having an exterior imaging surface and an interior back surface.

Figure 1:
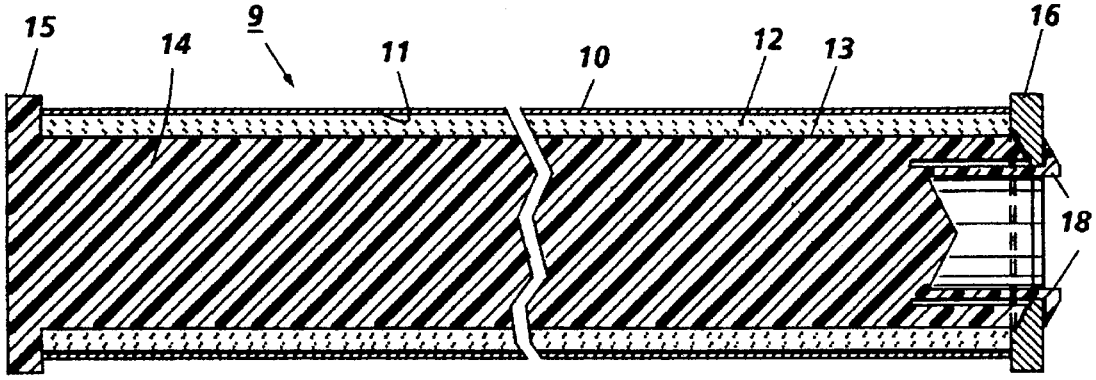
FIG. 1 illustrates a cross-sectional view of an electrostatographic imaging member assembly of this invention comprising a compressed resilient sleeve and rigid cylindrical core support member.

Referring to FIG. 1, an electrostatographic imaging member assembly 9 is illustrated comprising a flexible hollow cylindrical electrostatographic imaging drum 10 which comprises a hollow cylindrical substrate coated with at least one electrostatographic imaging layer. Since the electrostatographic imaging layer is relatively thin and since hollow cylindrical substrates coated with at least one electrostatographic imaging layer are well know in the art, drum 10 is merely generally depicted in FIG. 1 without specifically illustrating each separate layer. The cylindrical substrate component of drum 10 may comprise any suitable material such as aluminum, nickel, plastic, and the like and may be electrically conductive throughout its thickness or merely coated with an electrically conductive layer. The electrostatographic imaging layer component of drum 10 may comprise any suitable electrophotographic imaging material or an electrostatographic imaging material. Drum 10 has an interior back surface 11. Shown in contact with the interior back surface 11 of drum 10 is a preformed resilient compressible sleeve 12 under compression between the interior back surface 11 of drum 10 and the outer surface 13 of a rigid cylindrical core support member 14. Prior to insertion into the interior of drum 10, preformed resilient compressible sleeve 12 has an inside diameter less than the outside diameter of rigid cylindrical core support member 14. Also, prior to insertion into the interior of drum 10, preformed resilient compressible sleeve 12 normally has an outside diameter substantially equal to the inside diameter of drum 10. If desired, the outside diameter of sleeve 12 may initially be slightly smaller than the inside diameter of drum 10 and be subsequently expanded as core support member 14 is inserted into the interior of sleeve 12. The exterior surface of sleeve 12 will usually grab interior back surface 11 of drum 10 as the outer surface of sleeve 12 begins to expand as core support member 14 first enters one end of sleeve 12 after sleeve 12 has been positioned within the interior of drum 10. If drum 10 is rigid, the combination of core support member 14 within sleeve 12 offers ease of disassembly and reuse advantages over conventional drum support means.

Figure 2:
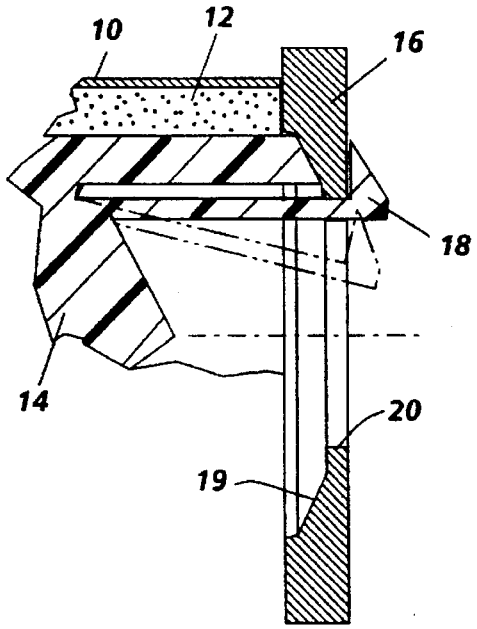
FIG. 2 illustrates an enlarged cross-sectional view of an embodiment of this invention in which an end cap is removably secured to the end of a rigid cylindrical core support member.

Rigid cylindrical core support member 14 has an integral end cap 15 at one end to limit how far support member 14 can be inserted into the interior of drum 10. The end of cylindrical core support member 14 opposite integral end cap 15 is free of any integral end cap. Removably attached to the free end of rigid cylindrical core support member 14 is a second end cap 16. Any suitable cap retaining means may be fitted to the end of rigid cylindrical core support member 14. Cantilevered snap locks 18 are a preferred retaining means. Second end cap 16 is slid onto the free end of cylindrical core support member 14 until it is locked in place by cantilevered snap locks 18 as shown in FIGS. 1 and 2. Tapered annular mating face 19 on second end cap 16 mates with a mirror image tapered annular mating face on the free end of support member 14 to center second end cap 16 with the axis of support member 14. The combination of the compressible sleeve 12 and inserted cylindrical core support member 14 provides rigid support for and prevents flexing of drum 10 during image cycling operations.

Figure 3:
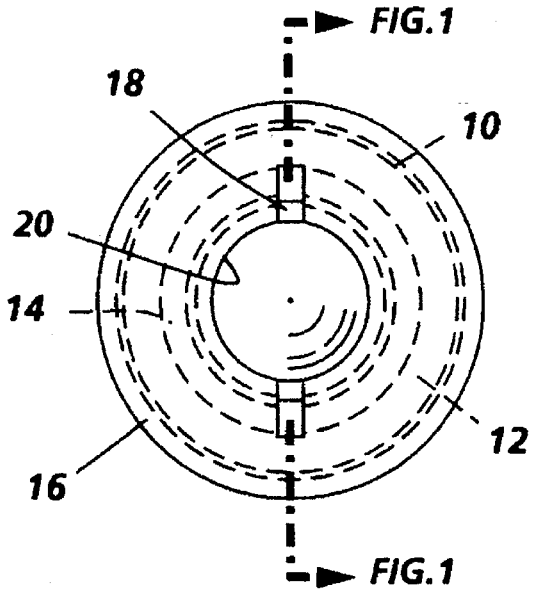
FIG. 3 illustrates an end view of electrostatographic imaging member assembly shown in FIG. 1.

Illustrated in FIG. 3 is an end view of the electrostatographic imaging member assembly 9 shown in FIGS. 1 and 2. This view is of the end containing second end cap 16 and shows how cantilevered snap locks 18 are flush with the circular bearing surface 20 of second end cap 16 to permit insertion of a supporting stub shaft or through shaft (not shown). The supporting stub shaft can be cantilevered from the frame of conventional electrostatographic imaging apparatus such as a copier, duplicator or printer (not shown) or from the frame of a cartridge or module (not shown) for insertion into a copier, duplicator or printer.

Figure 4:
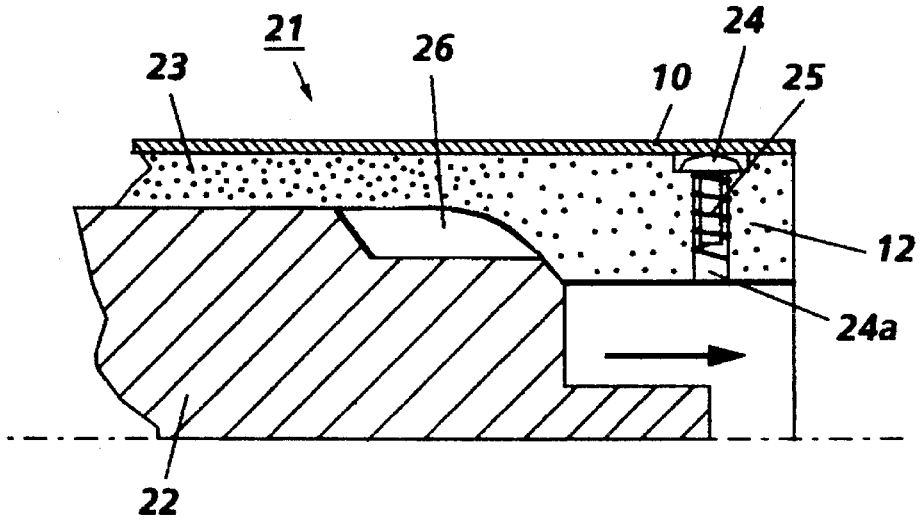
FIG. 4 illustrates a partial cross-sectional view of an electrostatographic imaging member of this invention during assembly.

Assembly of an electrostatographic imaging member assembly 21 is illustrated FIG. 4. After insertion of preformed resilient compressible sleeve 12 into the interior of drum 10 through either end of drum 10, rigid cylindrical core support member 22 is inserted into either end of drum 10 and into the interior of compressible sleeve 12 to progressively compress compressible sleeve 12 to form a compressed region 23. Insertion is continued until integral end cap 15 strikes the end of drum 10 and substantially all of compressible sleeve 12 is compressed. Drum 10 may be electrically grounded to an electrically conductive support member 22, a through shaft (not shown) or to an external ground such as a machine frame (not shown) by any suitable means such as a grounding brush (not shown) or pin 24. Pin 24 is urged through an aperture 24*a* in sleeve 12 against interior back surface 11 by coil spring 25 when the floor of slot 26 contacts spring 25 as support member 22 is fully inserted into the interior of drum 10. In another embodiment, drum 10 may be grounded to an electrically conductive core support member 22 by utilizing an electrically conductive foam sleeve 12. Still another alternative grounding method involves use of electrically conductive plastic or metal end caps 16 (see FIG. 2) which contact at least one end of drum 10.

Figure 5:
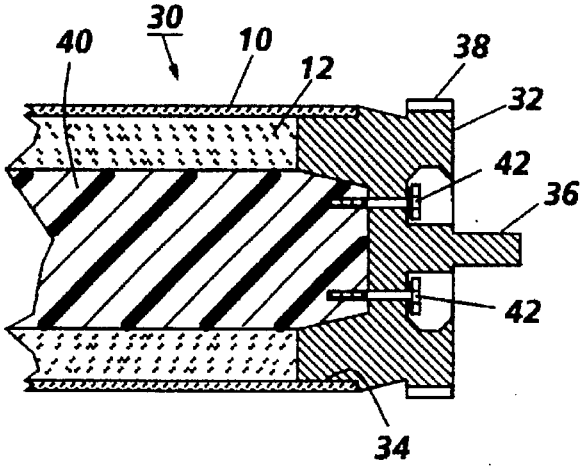
FIG. 5 illustrates an enlarged cross-sectional view of another embodiment of this invention in which an end cap is removably secured to the end of a rigid cylindrical core support member.

An expanded cross sectional end view of electrostatographic imaging member assembly 30 is shown in FIG. 5. This view includes a modified second end cap 32 having a circular landing or lip 34 which extends from the main body of end cap 32 into the interior of electrostatographic imaging member assembly 30 to assist in centering end cap 32 with the end of imaging drum 10 so that they are coaxial with each other. Lip 34 is particularly desirable if preformed resilient compressible sleeve 12 has a nonuniform composition. End cap 32 also carries a stub shaft 36 and a drive gear 38 that are an integral part of end cap 32, all being created during a single molding or machining operation. Alternatively, drive gear 38 can be a separate component (not shown) that is attachable to end cap 32. End cap 32 may be secured to the end of core support member 40 by self tapping screws 42.

Figure 6:
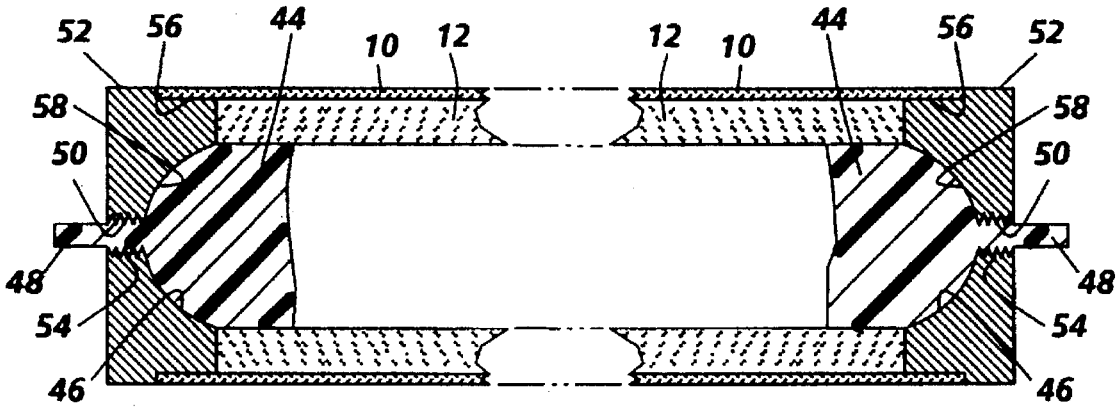
FIG. 6 illustrates an enlarged cross-sectional view of still another embodiment of this invention in which an end cap is removably secured to the end of a rigid cylindrical core support member.

In FIG. 6, another embodiment of this invention is illustrated in which a rigid cylindrical core support member 44 has at each end a rounded nose 46 to facilitate insertion into the interior of preformed resilient compressible sleeve 12. Rounded nose 46 may be of any suitable shape such as a bullet or parabolic shape which facilitates insertion of core support member 44 into the interior of sleeve 12. Core support member 44 also includes a support shaft 48 which carries male threads 50 for accepting second end cap 52 which contains female threads 54. Support shaft 48 can be an integral part of core support member 44 and can be formed by molding, machining or the like. Second end cap 52 also carries a landing or lip 56 which assists in centering end cap 52 on the end of electrostatographic imaging drum 10. In addition, second end cap 52 has a concave inner surface 58 which has a mirror image shape corresponding to the shape of rounded nose 46 to ensure coaxial alignment of support shaft 48 and drum 10. The end of support shaft 48 of support member 22 protrudes through end cap 52.

Figure 7:
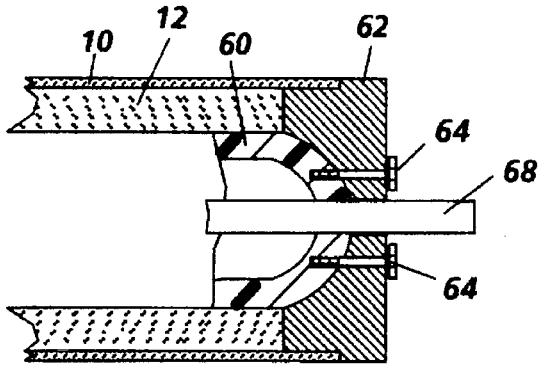
FIG. 7 illustrates an enlarged cross-sectional view of yet another embodiment of this invention in which an end cap is removably secured to the end of a rigid cylindrical core support member.

Still another embodiment of this invention is shown in FIG. 7. In this embodiment, rigid cylindrical core support member 60 is hollow. Also, second end cap 62 is fastened to the end of cylindrical core support member 60 by self tapping screws 64. In addition, electrostatographic imaging member assembly 66 is supported by a shaft 68 which extends through rigid cylindrical core support member 60 and second end cap 62.

Figure 8:
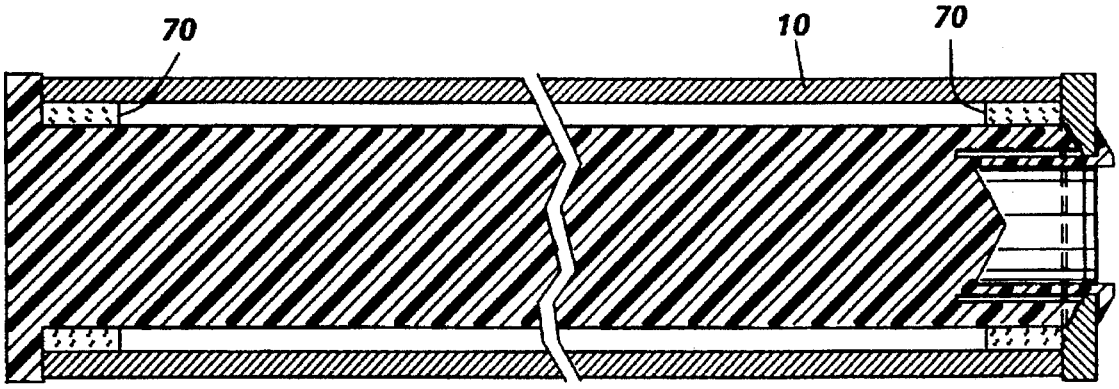
FIG. 8 illustrates a cross-sectional view of another embodiment of an electrostatographic imaging member assembly of this invention comprising a plurality of compressed resilient sleeves and a rigid cylindrical core support member.

In FIG. 8, still another embodiment of an electrostatographic imaging member assembly of this invention is illustrated in which the overall configuration is similar to that shown in FIG. 1, except that instead of the single preformed resilient compressible sleeve 12 under compression between the interior back surface 11 of drum 10 and the outer surface 13 of a rigid cylindrical core support member 14 shown in FIG. 1, at least two separate preformed resilient compressible sleeves 70 are positioned adjacent each end of drum 10. This arrangement may be employed when drum 10 is relatively rigid and does not need a continuous backing of compressed sleeve material to prevent flexing during image cycling.

The preformed resilient compressible sleeve may comprise any suitable porous gas filled material such as an open pore, closed pore, or composite open and closed pore sponge or expanded plastic foam. Alternatively, the preformed resilient compressible sleeve may comprise a compressible soft material free of gas filled pores such as natural rubber. Although a sleeve comprising rubber may expand in a direction parallel to the inner surface of the drum after being radially compressed between the inner surface of the drum and the outer surface of the cylindrical core support member, any expanded sleeve material extending beyond the end of the drum may be trimmed away by any suitable means such as a razor, scissors or the like. The outer circumference of the preformed resilient compressible sleeve should be substantially the same as or slightly smaller than the interior circumference of the imaging drum. If desired, the outer surface of the preformed resilient compressible sleeve may comprise a high coefficient of friction material to minimize sliding when the rigid cylindrical core support member is slid into the interior of the sleeve to compress the sleeve against the interior back surface of the hollow cylindrical photoreceptor. Sliding of the sleeve out of the drum may be prevented by any other suitable means such as by hand, temporary clamp, and the like. Some sliding of the sleeve in the drum may be acceptable and any excess sleeve material extending beyond the end of the drum after insertion of the cylindrical core support member can be cut away by any suitable means such as scissors, razor, a laser beam or the like. In addition, or alternatively, the exterior surface of the cylindrical core support member or interior surface of the sleeve may comprise a low coefficient of friction material such as polytetrafluoroethylene, a halogenated telomer or the like to reduce drag during insertion of the cylindrical core support member into the interior of the sleeve. The desired sleeve thickness depends on the durometer of the sleeve material used and the flexibility of the cylindrical photoreceptor employed. Thus, for example, stiffer, higher durometer sleeve materials can be thinner for stiffer, less flexible cylindrical photoreceptors.

A porous hollow sleeve split longitudinally along its axis or perpendicular to its axis may substituted for a preformed unitary sleeve for embodiments where the drum is rigid. However, where highly flexible drums are utilized and any gap in the split region will show through on the imaging surface of the drum as an undesirable distortion, a seamless sleeve having a smooth, uniform outer surface is preferred over split sleeves. Also, where suitable, the split or gap may form any other suitable path or pattern such as a spiral path from one end of the sleeve to the other end.

Any suitable preformed resilient compressible sleeve may be used in contact with the back surface of an electrostatographic imaging member assembly comprising an electrostatographic imaging member. Although, the preformed resilient compressible sleeve may comprise a compressible soft material free of gas filled pores such as solid natural rubber, the sleeve is preferably porous and with gas filled cavities. The gas filled cavities of the porous sleeve material may comprise open passages such as found in open cell foam, a plurality of closed cell cavities such as found in closed cell foam, or a composite of both types. Any suitable gas may be utilized. Typical gases include, for example, air, nitrogen, carbon dioxide, argon and the like. The solids in the preferred porous sleeve of this invention preferably has a relatively large amount of surface area in contact with a gas. Materials such as solid natural rubber are compressible and return to their original shape, but do not contain a gas. Compressibility, including the property of returning to its original shape (compression set), is important in order to cause the partially compressed compressible material to remain in place after installation in pressure contact with the back surface of the imaging member substrate, particularly when rotational power is applied to the cylindrical core support member. Preferred sleeve materials include cork, sponge, felt, open cell foam, closed cell foam, and composites of both types and the like. Typical foam material include, for example, polyurethane foam, expanded polystyrene foam, expanded polyethylene foam, silicone foam, polychloroprene foam, polysulfide foam, plasticized vinyl chloride foam, and the like. The presence of gas in the sleeve is preferred because it is compressible and facilitates the increasing of the compression force deflection (CFD) properties of the sleeve during compression between the rigid cylindrical core support member and the back surface of the imaging member substrate. Compression force deflection is a well known deflection test for compressible materials that is defined in ASTM D 3574 Test C. The desired CFD value for the sleeve depends upon the rigidity of the drum. For example, the CFD value can be lower for rigid, substantially inflexible drums. Thus, for a rigid imaging member substrate, the compression force deflection at about 25 percent deflection (compression) of the sleeve is preferably between about 3 psi and about 30 psi as measured according to ASTM D 3574 Test C. However, a CFD value that is too low will allow a very flexible substrate to deform. Thus, for a very flexible substrate, the lowest acceptable CFD is about 10 psi. Also, the CFD should be sufficiently high to prevent slippage between the sleeve and the adjacent rigid cylindrical core support member if the core support member is employed as part of the drive train that rotates the drum during image cycling. Thus, for example, for flexible drums having a thickness of less than about 50 micrometers, satisfactory results may be obtained with a sleeve having a CFD value of between about 10 psi and about 30 psi.

The sleeve may be completely compressed or only partially compressed after installation of the rigid cylindrical core support member. The amount of compression should be sufficient to prevent any discernible distortion of the drum during image cycling, and avert any relative movement between the rigid cylindrical core support member and the sleeve and the drum acceptable during image cycling. Preferably, the sleeve should be compressed by at least 20 percent of its original thickness to minimize any slippage between the rigid cylindrical core support member, sleeve and drum. Preferably, the sleeve of this invention also exhibits a low compression set value of less than about 2 percent to facilitate reuse when recycled. The phrase "compression set value" is defined in ASTM 1667 as the compressive set expressed as a percentage of the original thickness after exposure to a designated time at 25° C. The sleeve should also be preformed prior to installation in the imaging member. In other words, prior to insertion into the interior of the imaging member for subsequent compression, it should have a definite shape to which it can return to after compressive pressure is applied and released. A preformed resilient compressible sleeve can easily be slid into place within the interior of the imaging member manually or by robotic means and readily removed for recycling at the end of imaging life of the imaging member. The degree of compression existing in the sleeve after installation also depends upon the distortion resistance, i.e. rigidity, of the substrate utilized. Thus, for example, the amount of sleeve compression utilized for thin substrates should not be so great as to cause undesirable distortion of the substrate after installation and compression of the compressible sleeve.

The sleeve should also be positioned in contact with at least the entire backside of the imaging member opposite the exterior imaging area of the drum for flexible drums or at least at or near the ends of the imaging member between the end caps for rigid drums. The expression "flexible drums" is defined as drums or belts that flex discernibly to the naked eye when subjected to electrostatographic imaging cycle conditions while supported only by end caps. The phrase "rigid drums" is defined as drums that are free of any distortion discernible to the naked eye when subjected to electrostatographic imaging cycle conditions while supported only be end caps. The percent of the length of the cylindrical electrostatographic imaging member in contact with the sleeve material depends upon the flexibility of the drum and CFD of the sleeve material utilized. Generally, for embodiments where bands of sleeve material are positioned at each end of the core support as shown in FIG. 8, at least about 10 percent of the length of a rigid cylindrical electrostatographic imaging member is contacted with the sleeve material. For rigid drums the effectiveness of the sleeve material for driving a rigid drum diminishes as the points of contact between a pair of sleeves and the drum are positioned toward the center of the drum because the sleeves perform a spacing function and can also perform a stable drive function.

Instead of continuous contact, a plurality of segments of the interior surface of rigid drums may be contacted by the resilient compressible sleeve. Generally, satisfactory results may be achieved when the sum of segmental contacts by the resilient compressible sleeve along a circumferential band extending around the interior of the drum equals at least about 20 percent of the circumference. Preferably the resilient compressible sleeve is in contact with at least about 40 percent of the interior circumference of the hollow interior surface of an electrostatographic imaging member. Optimum results are achieved when contact includes at least about 60 percent of the interior circumference of rigid drums. Where the segmental contacts by the resilient compressible sleeve along a circumferential band extending around the interior of the drum is low, such segmental contact should be positioned to ensure that the axis of the rigid cylindrical core support member remains coaxial with the drum. This can be accomplished, for example, by uniformly positioning separate units or components of the segments around the rigid cylindrical core support member such as on opposite sides of the core support member or spaced 120° apart around the core support member. Since the area of each zone of segmental contact circumferentially or axially along a drum interior surface can be large or small and since the degree of flexibility of drums can vary with the specific substrate materials employed, some experimentation is desirable with specific combinations of materials utilized to determine the minimum amount of contact sufficient to support the drum and prevent slippage between the sleeve and the adjacent rigid cylindrical core support member during image cycling.

Where the compressible material is in the form of a sleeve such as illustrated, for example, in FIG. 1, the compressible material may be as thin as about 3 mm. The maximum thickness depends on the outside diameter of the core and inside diameter of the substrate utilized. Further, if desired, the sleeve may be layered with different layers having the same or different CFD values. However, the compressible sleeve material should be sufficiently thick to provide sufficient support for the drum and, where desired, to drive the drum with rotational power applied to the rigid cylindrical core support member.

The rigid cylindrical core support member should extend at least from one end of the drum to the other end. The rigid cylindrical core support member is preferably a solid or hollow unitary member. However, if desired, a first part of the core support member may be hollow, expandable and open at one end. The open end of the first part of the core support member is inserted into one end of the sleeve and drum assembly and a second part of the core support member having a tapered shape is slid into the other end of the sleeve and drum assembly, into the open end of the first part of the core support member and on into the interior of the first part of the core support member to expand the first part of the core support member, thereby forming a rigid core support member which compresses the sleeve against the interior surface of the drum. To facilitate expansion, the first part of the core support member contains at least one longitudinal slit and a tapered interior shaped to receive and be expanded by the insertion of the tapered second part. Expansion is achieved much like the splitting of a log through insertion of a cone shaped wedge into the center of one end of the log. If desired, a hole may extend axially through the cylindrical core support member to accept an axle shaft. as illustrated in FIG. 7. The core support member may be freely rotatable about the axle shaft or securely fastened thereto. Each end cap may be integral with one end of the rigid cylindrical core support member or removable therefrom, e.g. see integral end cap 15 and second end cap 16, respectively, in FIG. 1.

The cylindrical core support member may comprise any suitable sturdy solid or hollow material. Typical sturdy materials include, for example, plastics such as nylon, polycarbonate, ABS, PVC, polyester and the like, metals such as steel, stainless steel, aluminum, nickel, brass, and the like, and combinations thereof. Generally, for supporting flexible drums, the cylindrical core support member should have a circular cross section and the exterior surface thereof should be smooth and uniform to ensure that the durometer of the compressed sleeve is substantially uniform throughout its length and circumference. This prevents distortion of the flexible drum.

The electrostatographic imaging member may comprise an electrophotographic imaging member or an electrographic imaging member. Electrophotographic imaging members and electrographic imaging members are well know in the art and may be of any suitable configuration such as, for example, a rigid hollow cylinder, a flexible hollow cylinder or a flexible belt. Electrostatographic imaging members usually comprise a supporting substrate having an electrically conductive surface. Electrophotographic imaging members also comprise at least one photoconductive layer. A blocking layer may optionally be positioned between the substrate and the photoconductive layer. If desired, an adhesive layer may optionally be utilized between the blocking layer and the photoconductive layer. For multilayered photoreceptors, a charge generation layer is usually applied onto the blocking layer and a charge transport layer is subsequently formed over the charge generation layer. For electrographic imaging members, an electrically insulating dielectric layer is applied directly onto the electrically conductive surface.

The supporting substrate may be opaque or substantially transparent and may comprise numerous materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. The electrically insulating or conductive substrate may be rigid or flexible and in the form of a hollow cylinder, an endless flexible belt or the like.

The thickness of the supporting substrate layer depends on numerous factors, including beam strength, mechanical toughness, and economical considerations. Typical substrate layer thicknesses used for a flexible belt application may be of substantial thickness, for example, about 125 micrometers, or of a minimum thickness of not less than about 25 micrometers, provided that it produces no adverse effects on the belt. Typical substrate layer thicknesses used for a hollow cylinder application may range from about 75 micrometers to about 1500 micrometers.

The conductive layer may vary in thickness over substantially wide ranges depending on the optical transparency and degree of flexibility desired for the electrostatographic member. If the substrate is electrically conductive, a separate conductive layer may be unnecessary. For example, if the substrate is a metal such as an electroformed nickel or thin walled aluminum tube, a separate conductive layer may be omitted. Typical electroformed nickel substrates have a thickness between about 25 micrometers (about 0.001 inch) about 500 micrometers (about 0.020 inch).

An optional hole blocking layer may be applied to the substrate or conductive layer for photoreceptors. The hole blocking layer should be continuous and have a dry thickness of less than about 0.2 micrometer. An optional adhesive layer may be applied to the blocking layer. Any suitable adhesive layer well known in the art may be utilized. Satisfactory results may be achieved with the adhesive layer thickness between about 0.05 micrometer and about 0.3 micrometer.

Any suitable charge generating (photogenerating) layer may be applied onto the adhesive layer, blocking layer or conductive layer. Charge generating layers are well know in the art and can comprise homogeneous layers or photoconductive particles dispersed in a film forming binder. Examples of charge generating layers are described, for example, in U.S. Pat. No. 3,357,989, U.S. Pat. No. 3,442,781, and U.S. Pat. No. 4,415,639, the disclosures thereof being incorporated herein in their entirety. Other suitable photogenerating materials known in the art may also be utilized, if desired.

Any suitable polymeric film forming binder material may be employed as the matrix in of the photogenerating layer. Typical polymeric film forming materials include those described, for example, in U.S. Pat. No. 3,121,006, the disclosure thereof being incorporated herein in its entirety. The photogenerating composition or pigment may be present in the film forming binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition.

The photogenerating layer generally ranges in thickness from about 0.1 micrometer to about 5 micrometers, preferably from about 0.3 micrometer to about 3 micrometers. The photogenerating layer thickness is related to binder content. Higher binder content compositions generally require thicker layers for photogeneration.

The charge transport layer may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack. The charge transport layer should exhibit negligible, if any, discharge when exposed to a wavelength of light useful in electrophotography. The charge transport layer in conjunction with the charge generating layer is an insulator to the extent that an electrostatic charge placed on the charge transport layer is not conducted in the absence of illumination. Charge transport layer materials are well known in the art.

The charge transport layer may comprise activating compounds or charge transport molecules dispersed in normally, electrically inactive film forming polymeric materials. These charge transport molecules may be added to polymeric film forming materials. An especially preferred charge transport layer employed in multilayer photoconductors comprises from about 25 percent to about 75 percent by weight of at least one charge transporting aromatic amine, and about 75 percent to about 25 percent by weight of a polymeric film forming resin in which the aromatic amine is soluble. Examples of typical charge transporting aromatic amines include triphenylmethane, bis(4-diethylamine-2-methylphenyl)phenylmethane; 4'-4"-bis(diethylamino)-2', 2"-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis (3"-methylphenyl)-(1,1'biphenyl)-4,4'diamine; and the like, dispersed in an inactive resin binder.

Any suitable inactive resin binder may be employed. Typical resin binders include polycarbonate resins, polyvinylcarbazole, polyester, polyarylate, polyacrylate, polyether, polysulfone, and the like. Molecular weights can vary from about 20,000 to about 150,000.

The thickness of the charge transport layer may range from about 10 micrometers to about 50 micrometers, and preferably from about 20 micrometers to about 35 micrometers. Optimum thicknesses may range from about 23 micrometers to about 31 micrometers.

An optional conventional overcoating layer may also be used. The optional overcoating layer may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers.

For electrographic imaging members, a flexible dielectric layer overlying the conductive layer may be substituted for the photoconductive layers. Any suitable, conventional, flexible, electrically insulating dielectric polymer may be used in the dielectric layer of the electrographic imaging member.

This invention will further be illustrated in the following, non-limiting examples, it being understood that these examples are intended to be illustrative only and that the invention is not intended to be limited to the materials, conditions, process parameters and the like recited therein.

EXAMPLE I

A flexible photoconductive imaging member was provided comprising a hollow cylindrical photoreceptor having a length of 318 millimeters, an outside diameter of 40 millimeters and an inside diameter of 39.85 millimeters. This photoreceptor comprised an electroformed nickel substrate having thickness of 75 micrometers, a thin polysiloxane charge blocking layer, a charge generating layer having a thickness of 2 micrometers and comprising photoconductive pigment particles dispersed in a film forming binder, and a charge transport layer having a thickness of 20 micrometers and comprising an arylamine dissolved in a polycarbonate binder. A sleeve of open cell polyurethane foam having a length of 314 millimeters, an outside diameter of 39.90 millimeters and an inside diameter of 16 millimeters was slid into the interior of the hollow cylindrical photoreceptor until the ends of the sleeve were aligned adjacent the ends of the photoreceptor. The outer surface of the sleeve was in contact with the interior surface of the hollow cylindrical photoreceptor. The sleeve had a shape similar to the sleeve illustrated in FIG. 1. A rigid cylindrical core support member having a shape similar to that illustrated in FIG. 1 was inserted into the hollow interior of the sleeve and cylindrical photoreceptor assembly to compress the sleeve against the cylindrical photoreceptor. The core support member was a rigid polyvinyl chloride tube which had an outside diameter of 22 millimeters and length of 305 millimeters. The sleeve had a CFD value of 8 psi. No distortion of the hollow cylindrical photoreceptor was discernible. End caps similar to those illustrated in FIG. 1 were employed. When rotational power was applied to one end of the core support member, the photoreceptor rotated with no slippage between the core support member, sleeve and photoreceptor even when the hollow cylindrical photoreceptor was rubbed by a cleaning blade at 60 rpm.

The invention has been described in detail with particular reference to preferred embodiments thereof but it will be understood that variations and modifications can be effected within the spirit and scope of the invention as described herein above and as defined in the appended claims.

What is claimed is:

1. An electrostatographic imaging member assembly comprising a hollow cylindrical electrostatographic imaging member, said member comprising a substrate, an exterior imaging surface, an interior back surface, a first end and a second end, a rigid cylindrical core support member located within the interior of and coaxially aligned with said cylindrical electrostatographic imaging member, said cylindrical core support member having a rounded end and extending from at least said first end to said second end of said imaging member and having an outer surface spaced from said interior back surface of said hollow cylindrical photoreceptor, and at least one preformed resilient compressible sleeve under compression between said back surface of said imaging member and outer surface of said cylindrical core support, said compression being sufficient to render said electrostatographic imaging member substantially rigid and substantially free from distortion under electrostatographic image cycling conditions, said sleeve having an inside diameter and said cylindrical core having an outside diameter prior to inserting said cylindrical core support member within said interior of said cylindrical electrostatographic imaging member, and said inside diameter of said sleeve being less than said outside diameter of said cylindrical core.

2. An electrostatographic imaging member assembly according to claim 1 wherein said a rounded end of said rigid cylindrical core support member is removably secured to at least one end cap.

3. An electrostatographic imaging member assembly comprising a hollow cylindrical electrostatographic imaging member, said member comprising a substrate, an exterior imaging surface, an interior back surface, a first end and a second end, a rigid cylindrical core support member located within the interior of and coaxially aligned with said cylindrical electrostatographic imaging member, said cylindrical core support member having at least one tapered end and extending from at least said first end to said second end of said imaging member and having an outer surface spaced from said interior back surface of said hollow cylindrical photoreceptor, and at least one preformed resilient compressible sleeve under compression between said back surface of said imaging member and outer surface of said cylindrical core support, said compression being sufficient to render said electrostatographic imaging member substantially rigid and substantially free from distortion under electrostatographic image cycling conditions, said sleeve having an inside diameter and said cylindrical core having an outside diameter prior to inserting said cylindrical core support member within said interior of said cylindrical electrostatographic imaging member, and said inside diameter of said sleeve being less than said outside diameter of said cylindrical core.

4. An electrostatographic imaging member assembly according to claim 3 wherein said tapered end of said rigid cylindrical core support member is removably secured to at least one end cap.

5. An electrostatographic imaging member assembly comprising a hollow cylindrical electrostatographic imaging member, said member comprising a substrate, an exterior imaging surface, an interior back surface, a first end and a second end, a rigid cylindrical core support member located within the interior of and coaxially aligned with said cylindrical electrostatographic imaging member, said cylindrical core support member extending from at least said first end to said second end of said imaging member and having an outer surface spaced from said interior back surface of said hollow cylindrical photoreceptor, at least one preformed resilient compressible sleeve under compression between said back surface of said imaging member and outer surface of said cylindrical core support, said compression being sufficient to render said electrostatographic imaging member substantially rigid and substantially free from distortion under electrostatographic image cycling conditions, and end caps at each end of said imaging member, said rigid cylindrical core support member protruding through at least one of said end caps, said sleeve having an inside diameter and said cylindrical core having an outside diameter prior to inserting said cylindrical core support member within said interior of said cylindrical electrostatographic imaging member, and said inside diameter of said sleeve being less than said outside diameter of said cylindrical core.

6. An electrostatographic imaging member assembly according to claim 5 wherein said rigid cylindrical core support member protrudes through each of said end caps.

7. An electrostatographic imaging member assembly according to claim 5 wherein said rigid cylindrical core support member is integral with one of said end caps.

8. An electrostatographic imaging member assembly according to claim 5 wherein said rigid cylindrical core support member is removably secured to at least one of said end caps.

9. A process for fabricating an electrostatographic imaging member assembly comprising (a) providing a hollow cylindrical electrostatographic imaging member, said member comprising a substrate, an exterior imaging surface, an interior back surface, a first end, a second end and an inside diameter, (b) inserting at least one preformed resilient compressible sleeve within said hollow cylindrical electrostatographic imaging member, said sleeve having an inside diameter and outside diameter, said outside diameter being substantially equal to or slightly smaller than said inside diameter of said hollow cylindrical electrostatographic imaging member, and (c) inserting a rigid cylindrical core support member within the interior of and coaxially aligned with said preformed resilient compressible sleeve and said cylindrical electrostatographic imaging member, said cylindrical core support member (i) extending from at least said first end to said second end of said imaging member and (ii) having an outside diameter larger than said inside diameter of said compressible sleeve to compress said preformed resilient compressible sleeve between said back surface of said imaging member and said outer surface of said cylindrical core support, said compression being sufficient to render said electrostatographic imaging member substantially rigid and substantially free from distortion under electrostatographic image cycling conditions.

10. A process for fabricating an electrostatographic imaging member assembly according to claim 9 wherein said imaging member is flexible.

11. A process for fabricating an electrostatographic imaging member assembly according to claim 9 wherein said imaging member is rigid.

12. A process for fabricating an electrostatographic imaging member assembly according to claim 9 wherein said imaging member comprising an imaging layer and a substrate, said substrate having a thickness of between about 25 micrometers about 1000 micrometers.

13. A process for fabricating an electrostatographic imaging member assembly according to claim 9 wherein said imaging member substrate comprises a material selected from the group consisting of nickel, brass, aluminum, steel, stainless steel and plastic.

14. A process for fabricating an electrostatographic imaging member assembly according to claim 9 wherein said imaging layer comprises a charge generating layer and a charge transport layer.

15. A process for fabricating an electrostatographic imaging member assembly according to claim 9 wherein said preformed sleeve comprises a material selected from the group consisting of resilient porous gas filled material and solid natural rubber.

16. A process for fabricating an electrostatographic imaging member assembly according to claim 9 wherein said hollow cylindrical electrostatographic imaging member is rigid and said preformed sleeve has a CFD value of at least about 3 psi.

17. A process for fabricating an electrostatographic imaging member assembly according to claim 9 wherein said hollow cylindrical electrostatographic imaging member is flexible and said preformed sleeve has a CFD value between about 10 psi and about 30 psi.

18. A process for fabricating, an electrostatographic imaging member assembly according to claim 9 wherein said preformed sleeve material comprises open cell foam and said compression reduces the thickness of said sleeve by at least about 20 percent.

19. A process for fabricating an electrostatographic imaging member assembly according to claim 9 wherein said preformed sleeve material comprises closed cell foam.

20. A process for fabricating an electrostatographic imaging member assembly according to claim 9 wherein said preformed sleeve material comprises foam rubber.

21. A process for fabricating an electrostatographic imaging member assembly according to claim 9 wherein said preformed sleeve material comprises expanded plastic foam.

22. A process for fabricating an electrostatographic imaging member assembly according to claim 9 wherein said imaging member assembly comprises at least two of said preformed resilient compressible sleeves, one sleeve being positioned adjacent said first end and the other sleeve being positioned adjacent said second end of said hollow cylindrical electrostatographic imaging member.

23. A process for fabricating an electrostatographic imaging member assembly according to claim 9 wherein said rigid cylindrical core support member is hollow.

* * * * *